US007628522B2

(12) United States Patent
Yu et al.

(10) Patent No.: US 7,628,522 B2
(45) Date of Patent: Dec. 8, 2009

(54) LIGHT EMITTING DIODE LAMP

(75) Inventors: Fang-Xiang Yu, Shenzhen (CN); Shun-Yuan Jan, Taipei Hsien (TW); Chung-Yuan Huang, Santa Clara, CA (US)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 160 days.

(21) Appl. No.: 11/967,070

(22) Filed: Dec. 29, 2007

(65) Prior Publication Data

US 2009/0168427 A1 Jul. 2, 2009

(51) Int. Cl.
*F21V 29/00* (2006.01)

(52) U.S. Cl. ..... 362/547; 362/545; 362/373; 362/294; 362/800; 362/249.02

(58) Field of Classification Search ..... None
See application file for complete search history.

(56) References Cited

U.S. PATENT DOCUMENTS 7,237,936 B1 * 7/2007 Gibson ..... 362/547
2004/0264197 A1 * 12/2004 Bewig et al. ..... 362/294

* cited by examiner

*Primary Examiner*—Laura Tso
(74) *Attorney, Agent, or Firm*—Frank R. Niranjan

(57) ABSTRACT

A light emitting diode (LED) lamp (100) includes a heat sink (200), an LED module (400) attached to a bottom side of the heat sink (200), and an air exhausting duct (300). The air exhausting duct includes a cover (320) and a hollow tube (340) extending upwardly from the cover. The cover is mounted on a top side of the heat sink with an air collecting chamber (326) defined between the heat sink and the cover. The air collecting chamber communicates with an air passage (342) defined in the tube.

16 Claims, 5 Drawing Sheets

LIGHT EMITTING DIODE LAMP

BACKGROUND OF THE INVENTION

1. Field of the Invention

The present invention relates to an illuminating apparatus, and particularly to a light emitting diode lamp having good heat dissipation capability.

2. Description of Related Art

A light emitting diode (LED) is a device for transferring electricity to light by using a theory that, if a current is made to flow in a forward direction in a junction comprising two different semiconductors, electrons and holes are coupled at a junction region to generate a light beam. The LED has an advantage in that it is resistant to shock, and has an almost eternal lifetime under a specific condition, so LED lamps are used more and more as incandescent lamps replacements.

An LED lamp requires many LEDs, and most of the LEDs are driven at the same time, which results in a quick rise in temperature of the LED lamp. Since generally the LED lamp does not have a heat dissipation device with good heat dissipating efficiency, operation of the LED lamp has a problem of instability because of the rapid build up of heat. Consequently, the light from the LED lamp often flickers, which degrades the quality of the illumination.

What is needed, therefore, is an LED lamp, which can overcome the above-described disadvantages.

SUMMARY OF THE INVENTION

In accordance with an embodiment of the present invention, a light emitting diode lamp comprises a heat sink, an LED module attached to a bottom side of the heat sink and an air exhausting duct. The air exhausting duct comprises a cover and a hollow tube extending upwardly from the cover. The cover is mounted on a top side of the heat sink with an air collecting chamber defined between the heat sink and the cover. The air collecting chamber communicates with an air passage defined in the tube.

Other advantages and novel features of the present invention will become more apparent from the following detailed description when taken in conjunction with the accompanying drawings, in which:

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
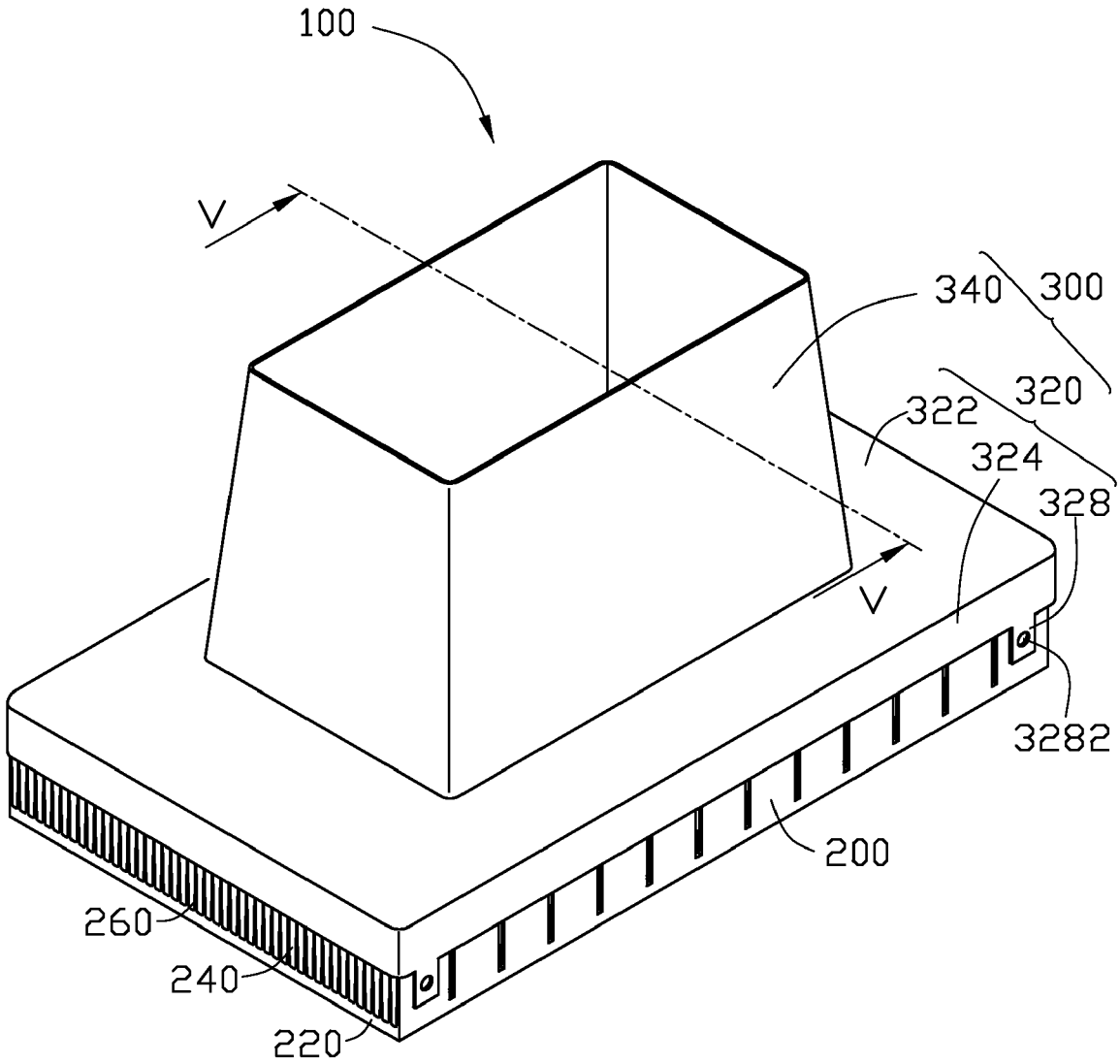
FIG. 1 is an assembled view of an LED lamp in accordance with a preferred embodiment of the present invention.
Figure 2:
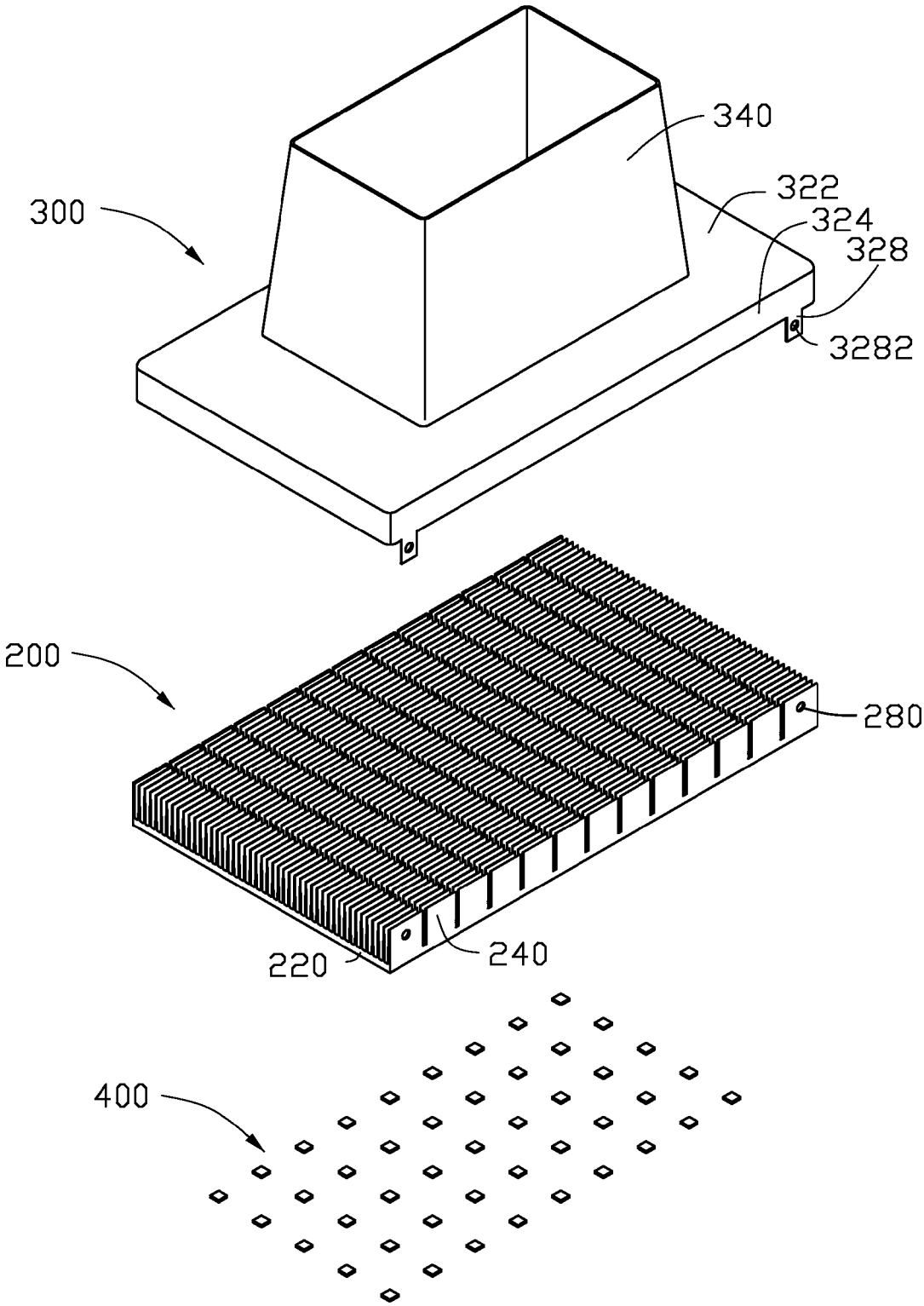
FIG. 2 is an exploded view of FIG. 1.
Figure 3:
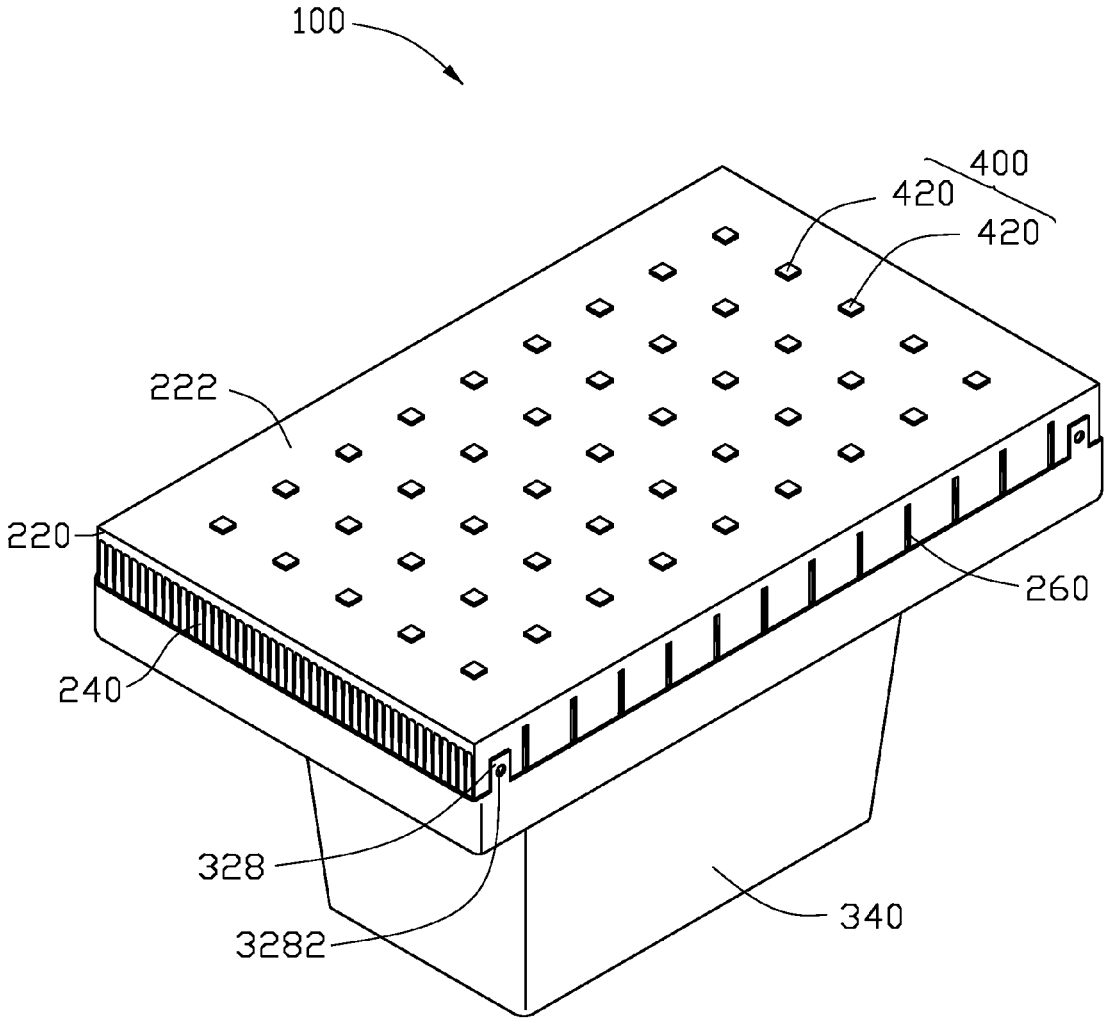
FIG. 3 is similar to FIG. 1, but viewed from an upside down aspect.
Figure 4:
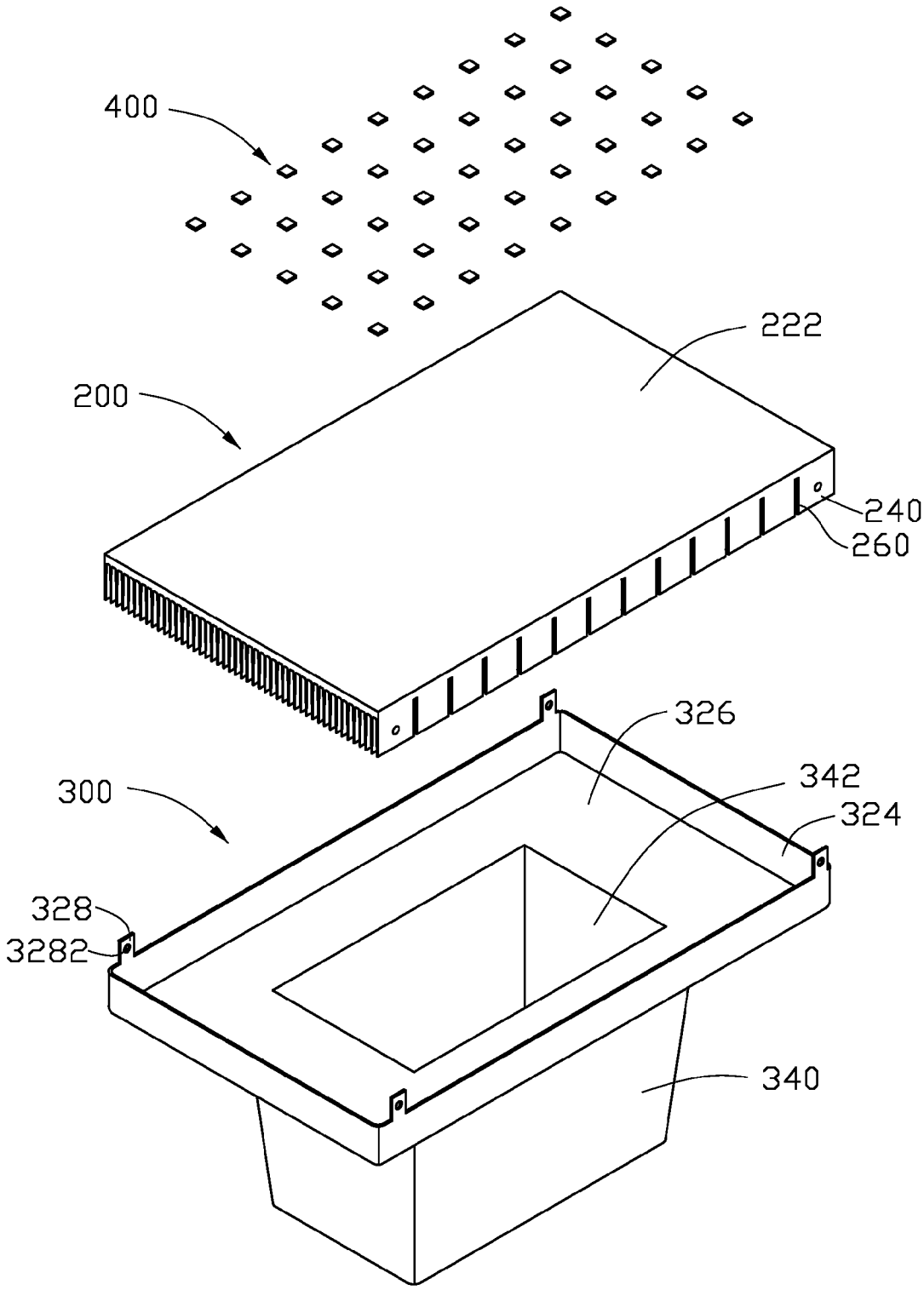
FIG. 4 is an exploded view of FIG. 3.
Figure 5:
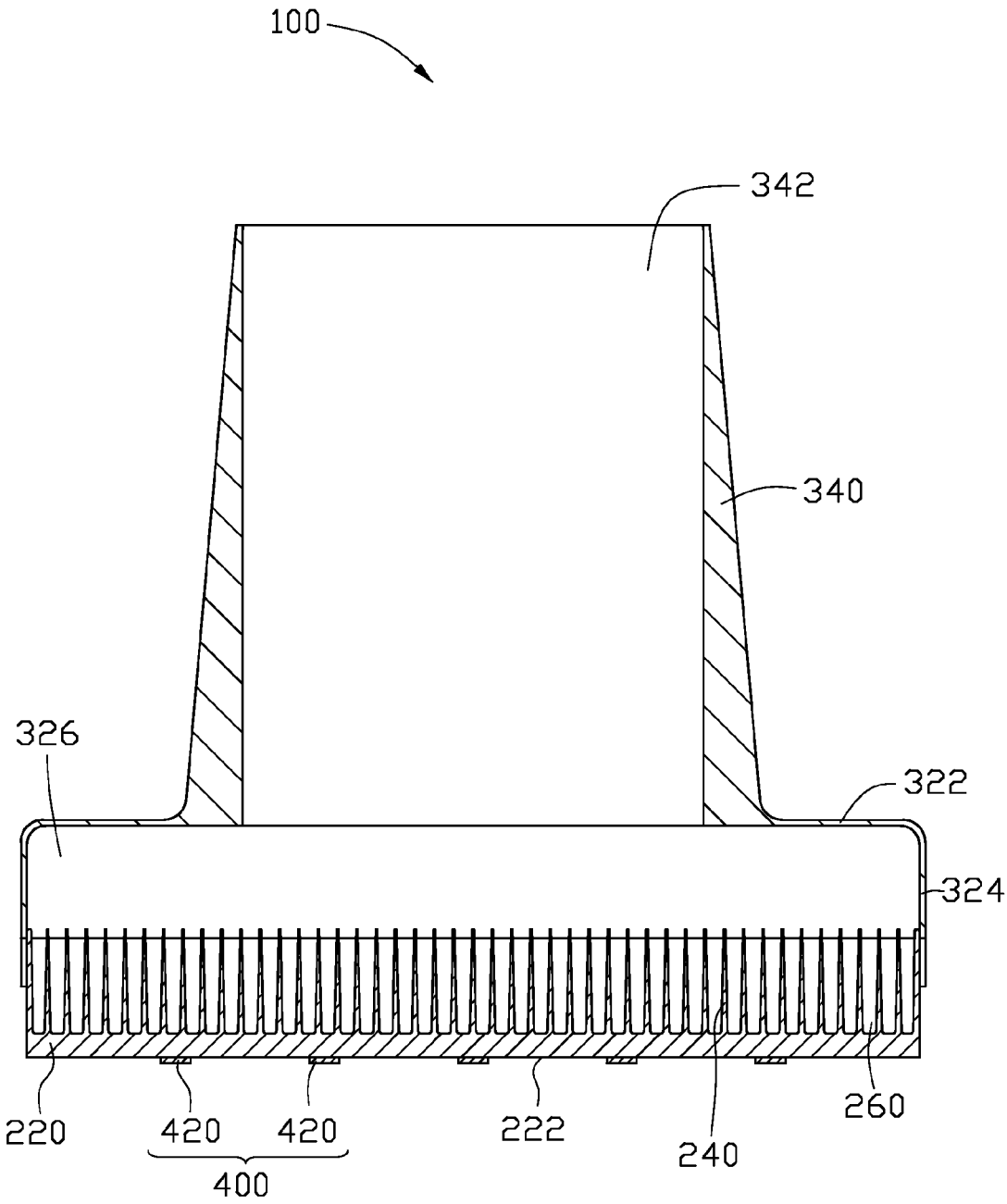
FIG. 5 is a cross-sectional view of FIG. 1 along line V-V.

Referring to FIGS. 1-5, a light emitting diode (LED) lamp 100 according to a preferred embodiment of the invention is illustrated. The LED lamp 100 comprises a heat sink 200, an air exhausting duct 300 disposed on a top side of the heat sink 200 and an LED module 400 attached to a bottom side of the heat sink 200.

The LED module 400 comprises a plurality of LEDs 420 electrically connected to a printed circuit board (not shown). Heat produced by the LEDs 420 is dissipated by the heat sink 200 and the air exhausting duct 300 so that the LEDs 420 can work within an acceptable temperature range.

The heat sink 200 comprises a base 220 and a plurality of parallel fins 240 mounted or formed on a top surface of the base 220. The base 220 has a bottom surface 222 in thermal contact with the LED module 400, absorbs the heat produced by the LED module 400, and conducts the heat upwardly to the fins 240. A plurality of channels 260 is defined between adjacent fins 240. The channels 260 serve as airflow passages for cooling air. Preferably, some of the channels 260 are oriented to extend in a longitudinal direction of the heat sink 200, and the other ones of the channels 260 are oriented to extend in a transverse direction of the heat sink 200. Thus, external cooling air flows into the channels 260 of the heat sink 200 along two perpendicular directions, absorbs the heat accumulated among the fins 240, and then exits the fins 240 from the air exhausting duct 300.

The air exhausting duct 300 can be made of metal, plastic or other material. The air exhausting duct 300 comprises a cover 320 and a hollow tube 340 extending upwardly from a center portion of the cover 320. The cover 320 comprises a rectangular base plate 322 and four sidewalls 324 extending downwardly from four sides of the base plate 322. The base plate 322 and the sidewalls 324 together define an air collecting chamber 326, which is communicated with an air passage 342 of the tube 340.

Two strip-like arms 328 are extended downwardly from a bottom edge of the left sidewall 324 and located at opposite sides of the left sidewall 324. Two strip-like arms 328 are extended downwardly from a bottom edge of the right sidewall 324 and located at opposite sides of the right sidewall 324. Each arm 328 has a through holes 3282 defined therein. The through holes 3282 are provided to secure the air exhausting duct 300 on the top side of heat sink 200.

When the air exhausting duct 300 is disposed on the top side of the heat sink 200, the base plate 322 is spaced from tip portions of the fins 240 with bottom portions of the sidewalls 324 enclosing an outer periphery of a top portion of the heat sink 200. In other words, the air collecting chamber 326 is formed between the tip portions of the fins 240 and the base plate 322. The air collecting chamber 326 serves to collecting hot air, which is heated up by the fins 240.

The arms 328 are located at right and left sides of the heat sink 200 and abut against the outermost fins 240 of the heat sink 200. Fasteners (not shown) such as screws are extended through the through holes 3282 of the arms 328 and screwed into the heat sink 200 so as to secure the air exhausting duct 300 on the heat sink 200. For facilitating secure of the air exhausting duct 300, a plurality of screw holes 280 is formed on the heat sink 200 corresponding to the through holes 3282 of the arms 328.

During operation of the LED lamp 100, the LED module 400 are driven to generate light and produce a great amount of heat. The heat of the LED module 400 is absorbed by the base 220, and upwardly conducted to the fins 240. Meanwhile, the external cooling air flows into the channels 260 of the heat sink 200 along two perpendicular directions and is heated into hot air by the fins 240. Since the hot air is lighter than the cooling air, the hot air flows upwardly into the air collecting chamber 326, then flows upwardly to enter into the air passage 342 of the tube 340, and finally exits the LED lamp 100 through the tube 340. At the same time, the external cooling air continuously flows into the channels 260 of the heat sink 200 as a result of pressure difference between the hot air and the cooling air.

In other words, the heat sink 200 and the air exhausting duct 300 dissipate the heat produced by the LED module 400 via the different densities between the hot air and the cool air. That is, the external cooling air flows into the channels 260 from a bottom portion of the heat sink 200, and then is heated by the fins 240 into the hot air. Since the density of the hot air is less than that of the cool air and the hot air will float upwardly into the air collecting chamber 326. Finally, the tube 340 guides the hot air to move upwardly. Therefore, by the presence of the air exhausting duct 300, a unidirectional airflow is formed in the heat sink 200. This accelerates the heat dissipation of the LED lamp 100, and the LED lamp 100 can work within an acceptable temperature range.

To prove the advantages of the above embodiment of the invention, a test is carried out. The LED lamp 100 and a conventional LED lamp, which is similar to the LED lamp 100 but without the air exhausting duct 300, are tested. The results are shown in table 1.

TABLE 1

| parameters | LED lamp100 | Conventional LED lamp |
|---|---|---|
| Ambient wind speed | No wind | No wind |
| Environment temperature | 20 degrees centigrade | 20 degrees centigrade |
| Power of each LED | 1 power | 1 power |
| Number of LEDs | 256 | 256 |
| Arrangement of LEDs | matrix | matrix |
| Temperature of LEDs | 55.2 degrees centigrade | 71.4 degrees centigrade |

Table 1 reveals that the LED lamp 100 has a better heat dissipation capability than the conventional LED lamp. Thus, the air exhausting duct 300 only can greatly improve the heat dissipation capability of the LED lamp 100 without utilizing fans.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A light emitting diode (LED) lamp comprising:

a heat sink;

an LED module attached to a bottom side of the heat sink; and an air exhausting duct comprising a cover and a hollow tube extending upwardly from the cover, the cover being mounted on a top side of the heat sink with an air collecting chamber defined between the heat sink and the cover, the air collecting chamber communicated with an air passage defined in the tube.

2. The LED lamp as described in claim 1, wherein the heat sink comprises a plurality of fins and a plurality of channels defined between adjacent fins, the channels are located below the exhaust air duct.

3. The LED lamp as described in claim 2, wherein some of the channels are oriented to extend in a longitudinal direction of the heat sink, and the other ones of the channels are oriented to extend in a transverse direction of the heat sink.

4. The LED lamp as described in claim 2, wherein the heat sink further comprises a base having a bottom surface in thermal contact with the LED module, the fins are provided on a top surface of the base.

5. The LED lamp as described in claim 1, wherein the cover comprises a base plate and a plurality of sidewalls extending downwardly from sides of the base plate, and the air collecting chamber is defined among the base plate, the sidewalls and the top side of the heat sink.

6. The LED lamp as described in claim 5, wherein the base plate is rectangular, and the sidewalls are extended perpendicularly and downwardly from four sides of the base plate.

7. The LED lamp as described in claim 5, wherein at least a strip-like arm is extended downwardly from a bottom edge of one of the sidewalls; at least a strip-like arm is extended downwardly from a bottom edge of another one of the sidewalls.

8. The LED lamp as described in claim 7, wherein the one of the sidewalls and the another one of the sidewalls are located at opposite sides of the cover.

9. The LED lamp as described in claim 7, wherein the heat sink further comprises a plurality of fasteners, the fasteners are extended through the arms and screwed into the heat sink.

10. The LED lamp as described in claim 5, wherein bottom portions of the sidewalls enclose an outer periphery of a top portion of the heat sink.

11. A light emitting diode (LED) lamp comprising:

a heat sink having a plurality of fins;

an LED module attached to a bottom side of the heat sink; and an air exhausting duct comprising a cover mounted on a top side of the heat sink and a hollow tube extending upwardly from the cover, wherein the cover comprises a base plate spaced from tip portions of the fins and a plurality of sidewalls extending downwardly from an outer periphery of the base plate, bottom portions of the sidewalls enclosing an outer periphery of a top portion of the fins.

12. The LED lamp as described in claim 11, wherein a plurality of arms is extended downwardly from bottom edges of the sidewalls and located at opposite sides of the heat sink, the arms engage with the heat sink to secure the air exhausting duct on the top side of the heat sink.

13. The LED lamp as described in claim 11, wherein a plurality of first channels is defined between adjacent fins and extends in a longitudinal direction of the heat sink, and a plurality of second channels is defined between adjacent fins and extends in a transverse direction of the heat sink.

14. A fanless LED lamp comprising:

a heat sink including a base and a plurality of fins, the base having a top surface and an opposite bottom surface, the fins provided on the top surface of the base and defining a plurality of channels therein for inhaling ambient cooling air;

at least an LED thermally attached to the bottom surface of the base, wherein heat generated by the at least an LED is transferred to the base and the fins of the heat sink; and an air exhausting duct attached to a top portion of the heat sink and enclosing an outer periphery of the fins, wherein the cooling air inhaled into the channels receives the heat of the at least an LED and becomes hot air, and the hot air floats upwardly and is guided by the air exhausting duct and finally discharged out of the air exhausting duct.

15. The fanless LED lamp as described in claim 14, wherein the air exhausting duct includes a cover and a hollow tube extending upwardly from a center portion of the cover, an air collecting chamber is formed between tip portions of the fins and the cover, an air passage is defined in the tube, and the air collecting chamber is communicated with the air passage.

16. The fanless LED lamp as described in claim 15, wherein a size of a transverse cross section of the air collecting chamber is larger than a size of a transverse cross section of the air passage.

* * * * *